United States Patent [19]

Doutrich

[11] Patent Number: 5,055,054

[45] Date of Patent: Oct. 8, 1991

[54] HIGH DENSITY CONNECTOR

[75] Inventor: Ray C. Doutrich, Lebanon, Pa.

[73] Assignee: E. I. Du Pont de Nemours and Company, Wilmington, Del.

[21] Appl. No.: 533,335

[22] Filed: Jun. 5, 1990

[51] Int. Cl.[5] ..... H01R 9/09

[52] U.S. Cl. ..... 439/66; 439/74; 439/289; 439/331

[58] Field of Search ..... 439/65, 66, 78, 68, 439/76, 74, 289, 330, 82, 331

[56] References Cited

U.S. PATENT DOCUMENTS

| | | | |
|---|---|---|---|
| 3,193,793 | 7/1965 | Plunkett et al. | 439/660 |
| 3,951,493 | 4/1976 | Kozel et al. . | |
| 3,960,424 | 6/1976 | Weisenburger . | |
| 4,199,209 | 4/1980 | Cherian et al. . | |
| 4,482,937 | 11/1984 | Berg | 439/65 X |
| 4,734,060 | 3/1988 | Kawawada et al. | 439/660 |
| 4,752,231 | 6/1988 | Olsson | 439/66 |
| 4,772,211 | 9/1988 | Asick et al. | 439/65 |
| 4,813,881 | 3/1989 | Kirby | 439/74 |
| 4,857,001 | 8/1989 | Nakano et al. | 439/68 |
| 4,877,409 | 10/1989 | Tanigawa et al. | 439/65 X |
| 4,891,019 | 1/1990 | Olsson | 439/404 |
| 4,909,746 | 3/1990 | Scholz | 439/74 X |

FOREIGN PATENT DOCUMENTS

| | | | |
|---|---|---|---|
| 2842892 | 4/1979 | Fed. Rep. of Germany | 439/65 |
| 1139612 | 1/1969 | United Kingdom | 439/65 |

*Primary Examiner*—Neil Abrams
*Assistant Examiner*—Khiem Nguyen
*Attorney, Agent, or Firm*—John E. Griffiths

[57] ABSTRACT

The present invention relates to electrical connectors for electrically connecting components and circuits on or in two parallel circuit boards and, more specifically, for electrically connecting components and circuits on or in two parallel circuit boards having a high density of interconnections.

40 Claims, 7 Drawing Sheets c47
c48
c49
c50
r1
r2
r3
r4
80
82
84
88
92
94
96
98
10
11
C1
C2
44
54
56
86
87
89
90
91
38
R1
R2
R3
R4
R5
R6
R7
R8

HIGH DENSITY CONNECTOR

BACKGROUND OF THE INVENTION

1. Field of the Invention

This invention relates to electrical connectors for electrically connecting components and circuits on or in two parallel circuit boards and, more specifically, for electrically connecting components and circuits on or in two parallel circuit boards having a high density of interconnections.

2. Description of Related Art

Many electronic connectors exist for electrically connecting electrical components or circuits on or connected to a first circuit board to electrical components or circuits on or connected to a second circuit board. Different connectors are typically used depending on whether the boards are parallel or perpendicular to one another.

Connectors exist which are "through mount connectable" to a board. Through mount connectable means the board has holes through it which are typically plated with a conductive material and the connector has pins, terminals or contact elements for inserting into and electrically connecting to the plated holes. Some pins are secured to the board by solder. Other pins are known as press-fit pins which have a compliant section that deforms when inserted into a hole forming an interference fit between the pin and the board to secure them together.

Other connectors are "surface connectable" to boards. Surface connectable means the board has pads or areas of conductive material on one of its surfaces and the connector has pins, terminals or contact elements for contacting and electrically connecting to the conductive pads or areas.

Circuit boards have conductive paths, leads or lines connected to each plated hole or pad for connection to the electrical components or circuits on or connected to the board. Specific hole or pad patterns in or on the boards have become standard which permit numerous connector designs for use with each hole or pad pattern.

Connectors exist having two rows of pins, terminals or contact elements designed to connect to a board having a pattern of two rows of holes or pads where the center of each hole or pad is spaced 0.100 inches to the center of adjacent holes or pads along the rows. This type of connector provides for a linear density of 20 lines per inch along its rows. Other connectors are available having two rows of pins, terminals or contact elements designed to connect to a board having a pattern of two rows of holes or pads where the center of each hole or pad is spaced 0.050 inches to the center of adjacent holes or pads along its rows. This type of connector provides for a linear density of 40 lines per inch along its rows.

Due to recent technological advances, electronic components and circuits are capable of being made much smaller than in the past. As a result, a very large number of components and circuits can now be mounted on or formed in a very small area or volume of a circuit board. New connectors must be developed to interconnect the smaller and more compactly positioned components and circuits on circuit boards.

As such, it is an object of this invention to provide an electrical connector for connecting to a pattern of holes or pads in or on a circuit board providing a linear density of more than 40 lines per inch, specifically 80 or about 80 lines per inch, along its rows.

Further, it is an object of this invention to provide an electrical connector that can be used for electrically connecting electrical components or circuits on or connected to parallel and spaced apart circuit boards.

It is another object of this invention to provide an electrical connector that is easily adaptable for both through mount connecting and surface connecting to a circuit board.

SUMMARY OF THE INVENTION

This invention is directed to a connector assembly for electrically and mechanically interconnecting a first circuit board having a first pattern of conductive regions with 80 or about 80 lead lines per inch with a second circuit board having a second pattern of conductive regions with 80 or about 80 lead lines per inch, the first circuit board being substantially parallel to and spaced apart from the second circuit board, the assembly comprising:

a male connector having a male terminal corresponding to each first pattern conductive region, each male terminal having a first end portion for connecting to one of the first pattern conductive regions and a second end portion; and a female connector having a female terminal corresponding to each second pattern conductive region, each female terminal having a first end portion for connecting to one of the second pattern conductive regions and a second end portion for electrically contacting the second end portions of the male connector terminals.

The invention is further directed to a connector assembly for electrically and mechanically interconnecting a first circuit board having a first pattern of conductive regions with 80 or about 80 lead lines per inch with a second circuit board having a second pattern of conductive regions with 80 or about 80 lead lines per inch, the first circuit board being substantially parallel to and spaced apart from the second circuit board, the connector assembly comprising:

a male connector having terminals with segments positioned in eight rows, each row having ten terminals per inch along the row, each of the terminals having a first end portion and a second end portion, the first end portions of the terminals for electrically and mechanically connecting to the first pattern of conductive regions of the first circuit board; and a female connector having terminals with segments positioned in eight rows, each row having ten terminals per inch along the row, each of the terminals having a first end portion and a second end portion, the first end portions of the terminals for electrically and mechanically connecting to the second pattern of conductive regions of the second circuit board, the second end portions of the male connector terminals for electrically contacting the second end portions of the female connector terminals.

The invention is further directed to a connector assembly for electrically and mechanically interconnecting a first circuit board having a first pattern of conductive regions with a second circuit board having a second pattern of conductive regions, the first circuit board being substantially parallel to and spaced apart from the second circuit board, the connector assembly comprising:

a male connector having terminals with segments positioned in a plurality of rows, each row having a plurality of terminals per inch along the row, each of the terminals having a first end portion and a second end portion, the first end portions of the terminals for electrically and mechanically connecting to the first pattern of conductive regions of the first circuit board, the male connector further comprising:

a housing having walls surrounding the second end portions of the male connector terminals, a passage for holding a middle portion of each of the male connector terminals, a plurality of columns of grooves, each of the grooves connected to at least one of the passages and shaped to permit the terminal held by the passage to be positioned in a first configuration in the groove when surface mountable to the first circuit board and in a second configuration in the groove when through hole mountable to the first circuit board;

a plurality of columns of a plurality of platforms for contacting the second end portions of the male connector terminals, the platforms having non-sharp edges for contacting a bend in the male connector terminals; and a serpentine groove extending between and around the columns of the platforms; and a female connector having terminals with segments positioned in a plurality of rows, each row having a plurality of terminals per inch along the row, each of the terminals having a first end portion and a second end portion, the first end portions of the terminals for electrically and mechanically connecting to the second pattern of conductive regions of the second circuit board, the second end portions of the male connector terminals for electrically contacting the second end portions of the female connector terminals.

The invention is further directed to a connector assembly for electrically and mechanically interconnecting a first circuit board having a first pattern of conductive regions with a second circuit board having a second pattern of conductive regions, the first circuit board being substantially parallel to and spaced apart from the second circuit board, the connector assembly comprising:

a male connector having terminals with segments positioned in a plurality of rows, each row having a plurality of terminals per inch along the row, each of the terminals having a first end portion and a second end portion, the first end portions of the terminals for electrically and mechanically connecting to the first pattern of conductive regions of the first circuit board; and a female connector having terminals with segments positioned in a plurality of rows, each row having a plurality of terminals per inch along the row, each of the terminals having a first end portion and a second end portion, the first end portions of the terminals for electrically and mechanically connecting to the second pattern of conductive regions of the second circuit board, the second end portions of the male connector terminals for electrically contacting the second end portions of the female connector terminals, the female connector further comprising:

a housing having an indentation surrounding the second end portions of the female connector terminals, a passage for holding a middle portion of each of the female connector terminals, a plurality of columns of grooves, each of the grooves connected to at least one of the passages and shaped to permit the terminal held by the passage to be positioned in a first configuration in the groove when surface mountable to the second circuit board and in a second configuration in the groove when through hole mountable to the second circuit board;

a plurality of columns of a plurality of platforms, each platform positioned near one of the second end portions of the female connector terminals, the platforms having non-sharp edges for contacting a bend in the female connector terminals; and a serpentine wall extending between and around the columns of the platforms.

The invention is further directed to a connector for electrically and mechanically connecting to a pattern of eight rows of plated holes through a circuit board providing a linear density of 80 or about 80 lead lines per inch, the connector comprising:

a terminal corresponding to each hole, each terminal having a first end portion for connecting to one of the holes and a second end portion for connecting to a conductor; and means for housing the terminals such that the terminals are electrically insulated from each other.

The invention is further directed to a male connector for electrically and mechanically connecting to a circuit board having a pattern of conductive regions with a plurality of lead lines per inch, the male connector comprising:

terminals with segments positioned in a plurality of rows, each row having a plurality of terminals per inch along the row, each of the terminals having a first end portion and a second end portion, the first end portions of the terminals for electrically and mechanically connecting to the pattern of conductive regions of the circuit board;

a housing having walls surrounding the second end portions of the male connector terminals, a passage for holding a middle portion of each of the male connector terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board, wherein the male connector housing further comprises:

a plurality of columns of a plurality of platforms for contacting the second end portions of the male connector terminals, the platforms having non-sharp edges for contacting a bend in the male connector terminals; and a serpentine groove extending between and around the columns of the platforms.

The invention is further directed to a female connector for electrically and mechanically connecting to a circuit board having a pattern of conductive regions with a plurality of lead lines per inch, the female connector comprising:

terminals with segments positioned in a plurality of rows, each row having a plurality of terminals per inch along the row, each of the terminals having a first end portion and a second end portion, the first end portions of the terminals for electrically and mechanically connecting to the pattern of conductive regions of the circuit board; and a housing having an indentation surrounding the second end portions of the female connector terminals, a passage for holding a middle portion of each of the female connector terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board, wherein the female connector housing further comprises:

a plurality of columns of a plurality of platforms, each platform positioned near one of the second end portions of the female connector terminals, the platforms having non-sharp edges for contacting a bend in the female connector terminals; and a serpentine wall extending between and around the columns of the platforms.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
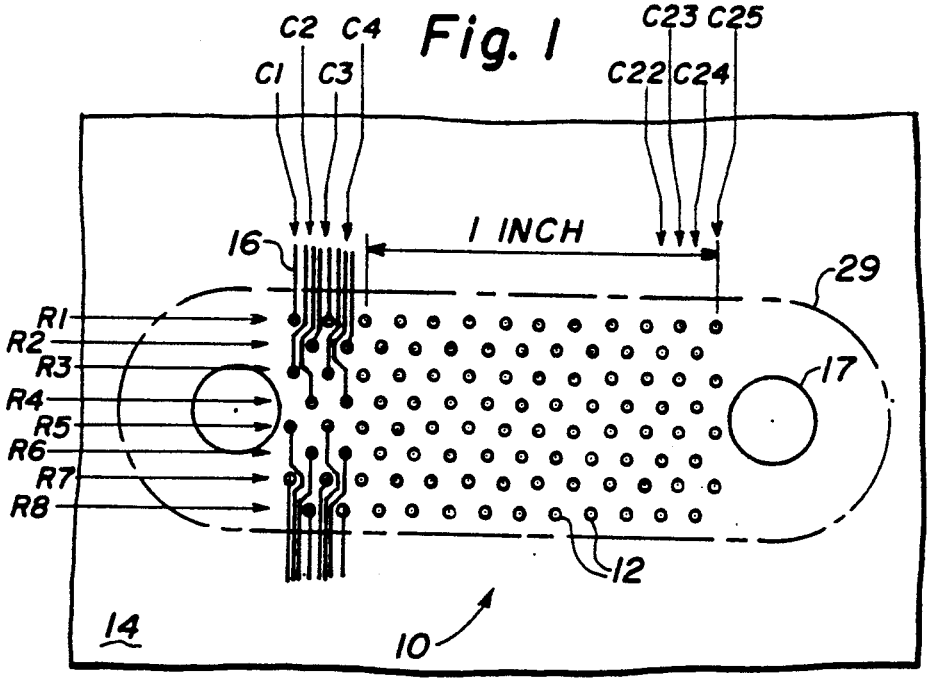
FIG. 1 is a pattern of holes through a circuit board that provides a linear density of 80 or about 80 lead lines per inch of connector length.

Throughout the following detailed description, similar reference characters refer to similar elements in all figures of the drawings.

The present invention is directed to an apparatus comprising a high density connector or means for electrically and mechanically connecting to a pattern of conductive regions on a circuit board that provides a linear density of 80 or about 80 lead lines per inch. The present invention is further directed to an assembly comprising a high density connector assembly or means for electrically and mechanically interconnecting a first circuit board having a first pattern of conductive regions with 80 or about 80 lead lines per linear inch with a second circuit board having a second pattern of conductive regions with 80 or about 80 lead lines per linear inch, the first circuit board being substantially parallel to and spaced apart from the second circuit board.

Referring to FIG. 1, there is an enlarged plan view of a pattern 10 of holes 12 through a circuit board 14 that provides a linear density of 80 or about 80 lead lines 16 per inch. Lead lines 16 are illustrated connected to the left four columns $C_1$–$C_4$ of holes 12 in FIG. 1. The lead lines 16 connected to the holes 12 in rows $R_1$–$R_4$ extend generally perpendicularly away from the rows $R_1$–$R_8$ in a first direction (towards the top of the page in FIG. 1). The lead lines 16 connected to the holes 12 in rows $R_5$–$R_8$ extend generally perpendicularly away from the rows $R_1$–$R_8$ in a second direction (towards the bottom of the page in FIG. 1) opposite to the first direction. For simplicity, the lead lines 16 have been left off most of the holes 12 in FIG. 1, but it should be understood that all of the holes 12 are or can be connected to lead lines 16 as illustrated with respect to the left four columns of holes 12. Although not shown in FIG. 1, the holes 12 are plated with a conductive material.

The pattern 10 has eight rows $R_1$–$R_8$ of holes 12. Each of the rows $R_1$–$R_8$ extends from left to right (or right to left) in FIG. 1. Each of the rows $R_1$–$R_8$ has ten (10) holes per inch along the row. The rows $R_1$–$R_8$ can extend for more or less than an inch. Twenty-five (25) columns $C_1$–$C_{25}$ of holes 12 are depicted. However, since the length of the rows $R_1$–$R_8$ can extend for more or less than an inch, the pattern 10 can have more or less columns than illustrated. An inch has been shown in FIG. 1 giving the viewer a perspective of the actual size of the pattern 10 and showing that the pattern contains 80 holes 12 (i.e., 8 rows with 10 holes per inch in each row) and, thus, 80 lead lines 16 per linear inch of the pattern 10.

Each of the rows $R_1$–$R_8$ can be offset with respect to adjacent rows. Specifically, in FIG. 1, rows $R_1$, $R_3$, $R_5$ and $R_7$ re offset slightly to the left of rows $R_2$, $R_4$, $R_6$ and $R_8$. The holes 12 in rows $R_2$, $R_4$, $R_6$ and $R_8$ are spaced along the rows $R_2$, $R_4$, $R_6$ and $R_8$ exactly between the holes 12 in adjacent rows $R_1$, $R_3$, $R_5$ and $R_7$.

The holes 12 can be spaced about 0.1 inches from hole center to hole center of adjacent holes 12 along the rows $R_1$–$R_8$. The holes 12 can have a diameter of about 0.020 inches. The distance between adjacent rows $R_1$–$R_8$ can be about 0.075 inches.

The pattern 10 may also have a pair of larger alignment holes 17, one on each end of the rowS $R_1$–$R_8$.

Figure 2:
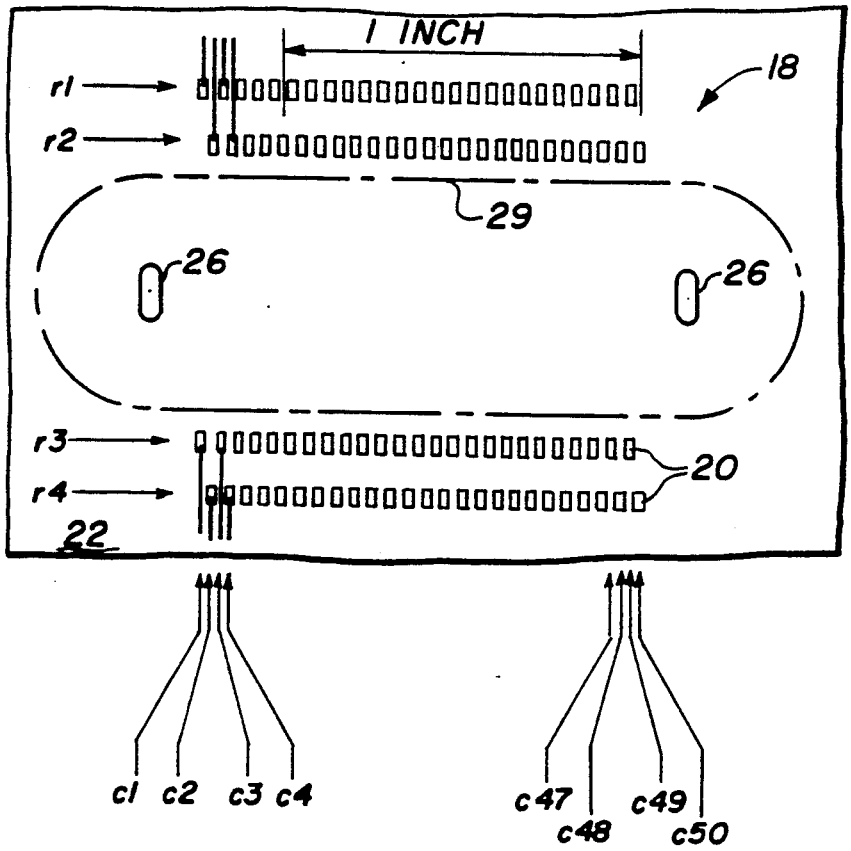
FIG. 2 is a pattern of pads on a circuit board that provides a linear density of 80 or about 80 lead lines per inch of connector length.

FIG. 2 is an enlarged plan view of a pattern 18 of pads 20 on a circuit board 22 that provides a linear density of 80 lead lines 24 per inch of connector length or along the board 22. The pattern 18 has four rows $r_1$–$r_4$ of pads 20. Similar to FIG. 1, lead lines 24 are illustrated connected to the left four columns $c_1$–$c_4$ of pads 20. The lead lines 24 connected to the pads 24 in rows $r_1$ and $r_2$ extend generally perpendicularly away from the rows $r_1$–$r_4$ in a first direction (towards the top of the page in FIG. 2). The lead lines 24 connected to the pads 20 in rows $r_3$ and $r_4$ extend generally perpendicularly away from the rows $r_1$–$r_4$ in a second direction (towards the bottom of the page in FIG. 2) opposite to the first direction. For simplicity, the lead lines 24 have been left off most of the pads 20 in FIG. 2, but it should be understood that all of the pads 24 are or can be connected to lead lines 24 as illustrated with respect to the left four columns of the pads 20.

Each of the four rows $r_1$–$r_4$ has twenty (20) or about twenty (20) pads 20 per inch along the row. The rows $r_1$–$r_4$ can extend for more or less than an inch. Fifty (50) columns $c_1$–$c_{50}$ of holes 12 are depicted. However, since the length of the rows $r_1$–$r_4$ can extend for more or less than an inch, the pattern 10 can have more or less columns than illustrated. An inch has been shown in FIG. 2 giving the viewer a perspective of the actual size of the pattern 18 and showing that the pattern contains 80 pads 20 (i.e., 4 rows with 20 pads per inch in each row) and, thus, 80 lead lines 24 per linear inch of the pattern 18.

Each of the rows $r_1$–$r_4$ can be offset with respect to adjacent rows. Specifically, in FIG. 2, rows $r_1$ and $r_3$ are offset slightly to the left of rows $r_2$ and $r_4$. The pads 20 in the rows $r_2$ and $r_4$ are spaced along the rows $r_2$ and $r_4$ exactly between the pads 20 in adjacent rows $r_1$ and $r_3$.

The pads 20 can be spaced about 0.050 inches apart from pad center to pad center of adjacent pads 20 along the rows $r_1$–$r_4$. The distance from pad center to pad center of pads 20 in adjacent rows $r_1$ and $r_2$ and in adjacent rows $r_3$ and $r_4$ can be about 0.15 inches. The distance from pad center to pad center of pads 20 in adjacent rows $r_2$ and $r_3$ can be about 0.826 inches.

The pattern 18 may also have a pair of larger alignment holes 26, one on each end of the rows $r_1$–$r_4$ between row $r_2$ and row $r_3$.

Figure 3:
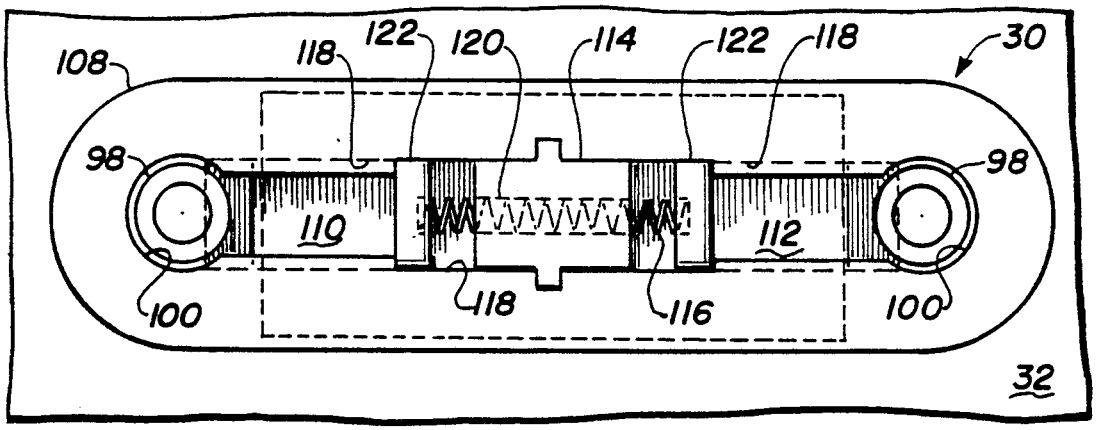
FIG. 3 is a top side view of a high density connector assembly in accordance with the present invention.
Figure 4:
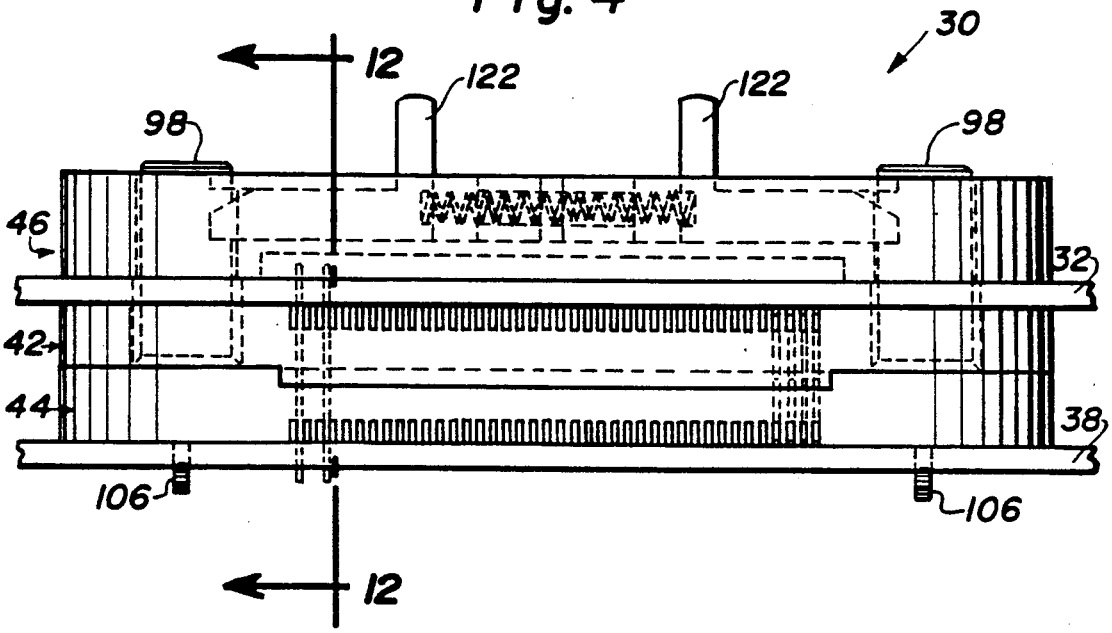
FIG. 4 is a front side view of the high density connector assembly of FIG. 1.
Figure 5:
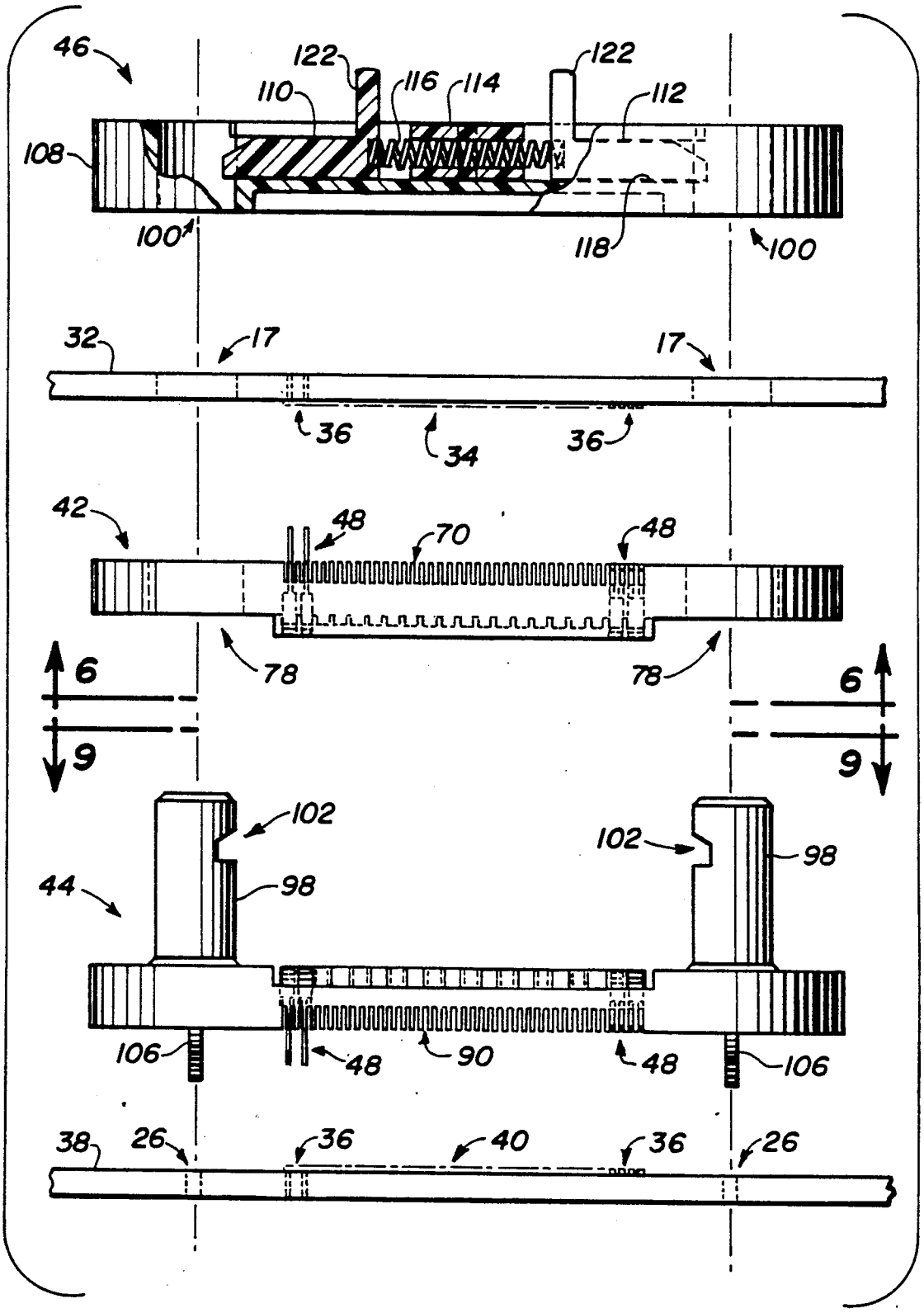
FIG. 5 is an exploded front side view showing unassembled components of the high density connector assembly of FIG. 3.

FIG. 3 is a top side view of a high density connector assembly 30 in accordance with the present invention. FIG. 4 is a front side view of the high density connector assembly 30 of FIG. 1. FIG. 5 is an exploded front side view showing unassembled components of the high density connector assembly 30 of FIGS. 3 and 4. The high density connector assembly 30 generally comprises a male connector 42, a female connector 44 and a latching assembly 46.

In FIGS. 3 and 4, the high density connector assembly 30 is depicted electrically and mechanically interconnecting a first circuit board 32 having a first pattern 34 of conductive regions 36 with 80 lead lines per linear inch of the connector assembly 30 with a second circuit board 38 having a second pattern 40 of conductive regions 36 with 80 lead lines per linear inch of the connector assembly 30. The first pattern 34 of conductive regions 36 and the second pattern 40 of conductive regions 36 are illustrated in FIG. 5. The first pattern 34 of conductive regions 36 is either the pattern 10 illustrated in FIG. 1 with the conductive regions 36 being the holes 12 or the pattern 18 illustrated in FIG. 2 with the conductive regions being the pads 20. Similarly, the second pattern 40 of conductive regions 36 is either the pattern 10 illustrated in FIG. 1 with the conductive regions 36 being the holes 12 or the pattern 18 illustrated in FIG. 2 with the conductive regions being the pads 20. The first circuit board 32 is substantially parallel to and spaced apart from the second circuit board 38. Preferably, they are spaced between about 0.4 inches and 1.2 inches apart.

Figure 6:
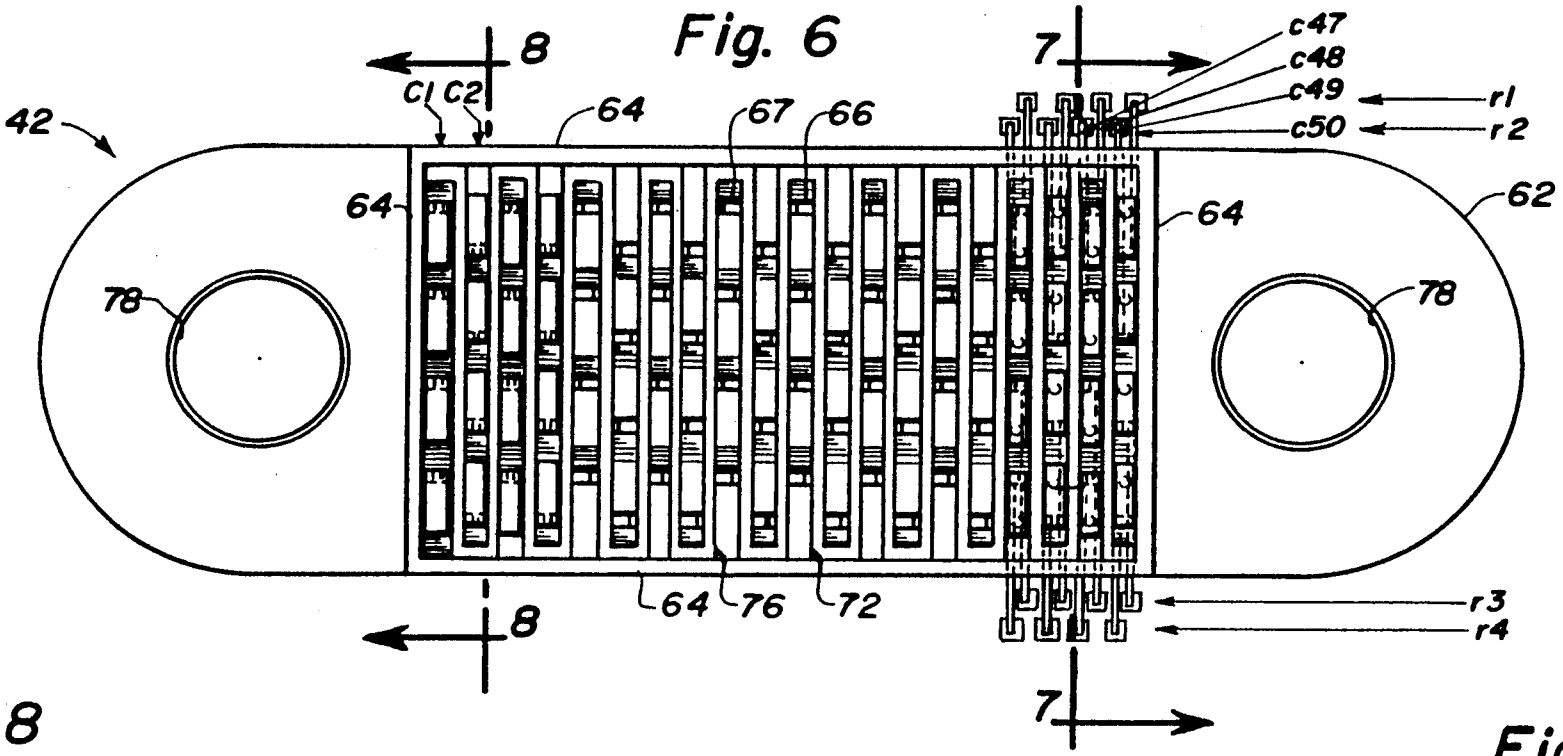
FIG. 6 is a bottom side view of a male connector taken generally on the line 6—6 in FIG. 5 in the direction of the arrows.
Figure 7:
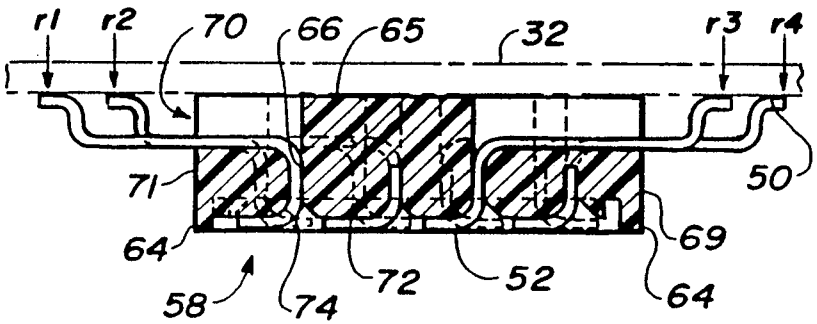
FIG. 7 is a sectional view of the male connector, taken generally on the line 7—7 in FIG. 6 in the direction of the arrows, showing terminals for surface mounting on a circuit board.
Figure 8:
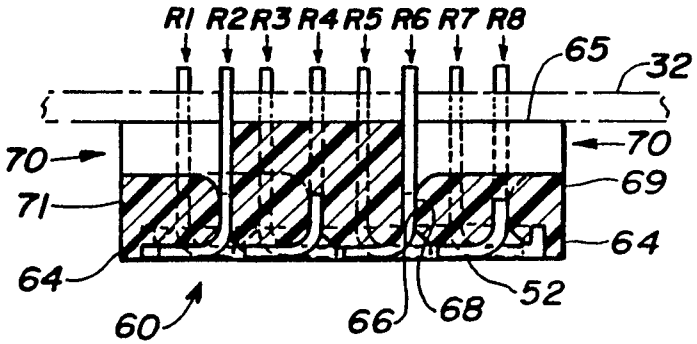
FIG. 8 is a sectional view of the male connector, taken generally on the line 8—8 in FIG. 6 in the direction of the arrows, showing terminals for through mounting with a circuit board.

FIG. 6 is a bottom side view of the male connector 42 taken generally on the line 6—6 in FIG. 5 in the direction of the arrows. FIG. 7 is a sectional view of the male connector 42, taken generally on the line 7—7 in FIG. 6 in the direction of the arrows, showing terminals 58 for surface mounting on the circuit board 32. FIG. 8 is a sectional view of the male connector 42, taken generally on the line 8—8 in FIG. 6 in the direction of the arrows, showing terminals 60 for through mounting with the circuit board 32.

Actually, the male connector 42 only has either terminals 58 for surface mounting or terminals 60 for through mounting, not both. In a first embodiment, the male connector 42 is for connecting to the pattern 18 illustrated in FIG. 2. In this first embodiment, all of the terminals 48 of the male connector 42 are surface mounting terminals 58. In a second embodiment, the male connector 42 is for connecting to the pattern 10 illustrated in FIG. 1. In this second embodiment, all of the terminals 48 of the male connector 42 are through mounting terminals 60. However, in order to reduce the number of figures needed to illustrate both embodiments, a right set $c_{47}$–$c_{50}$ of columns of terminals 48 in FIGS. 4, and 6 are depicted as terminals 60 for surface mounting and a left set $C_1$–$C_2$ of columns of terminals 48 in FIGS. 4, 5 and 6 are depicted as terminals 60 for through mounting. In order to better understand the structure of the connector assembly 30, the terminals 48 between the left set $C_1$–$C_2$ and the right set $c_{47}$–$c_{50}$ are not depicted.

The male connector 42 comprises a terminal 48 for connecting to each conductive region in the pattern 10 or 18. Each male connector terminal 48 comprises a first end portion or segment 50, a second end portion or segment 52 and a middle portion or segment 68. The first end portions 50 of the terminals 48 are for electrically and mechanically connecting to the first pattern 34 of conductive regions 36 of the first circuit board 32. The second end portions 52 of the male connector terminals 48 are for electrically contacting second end portions or segments 54 of the female connector terminals 48.

The male connector 42 further comprises a housing 62 having exterior walls 64 surrounding the second end portions 52 of the male connector terminals 48. The housing 62 comprises means for housing the male terminals 48 such that the male terminals are electrically insulated from each other.

The male connector 42 further defines a passage 66 for holding the middle portion 68 of each of the male connector terminals 48. The middle portions 68 are physically arranged in the passages 66 in the eight rows $R_1$–$R_8$. Each of the rows $R_1$–$R_8$ of middle portions 68 is offset with respect to adjacent rows. Each passage 66 includes a ledge 67 for contacting a shoulder 69 on the terminal 48 positioned in the passage 66. In FIG. 6, the ledges 67 are on the left side of the passages 66 corresponding to the rows $R_1$, $R_2$, $R_5$ and $R_6$ of the terminal middle portions 68. Whereas, the ledges 67 are on the right side of the passages 66 corresponding to the rows $R_3$, $R_4$, $R_7$ and $R_8$ of the terminal middle portions 68.

A plurality of columns of tunnels or grooves 70 exist in a side 65 of the male connector 42 which contacts the circuit board 32. Each of the grooves 70 extends from one of the passages 66 and is shaped to permit the first end portion 50 of the terminal 48 held by the passage 66 to be positioned in a first configuration in the groove 70 when surface mountable to the first circuit board 32 and in a second configuration in the groove 70 when through hole mountable to the first circuit board 32. Surface mountable terminals are designated by the number 58. Through hole mountable terminals are designated by the number 60. Each one of the grooves 70 extends from an end of one of the passages 66 vertically towards the top of the page in FIGS. 7 and 8 to the side or surface 65 of the male connector 42 that contacts the first circuit board 32. Each one of the grooves 70 further extends from an end of one of the passages 66 horizontally in FIGS. 7 and 8 to either a right side 69 or a left side 71 of the male connector 42. When the terminals 48 are through hole mountable terminals 60, the first end portions 50 of the terminals 60 are physically arranged in the eight rows $R_1$–$R_8$. Each of the rows $R_1$–$R_8$ of the first end portion offset with respect to adjacent rows of the first end portions 50. When the terminals 48 are surface mountable terminals 58, the first end portions 50 of the terminals 58 are physically arranged in four rows $r_1$–$r_4$. Each of the rows $r_1$–$r_4$ of the first end portions 50 is offset with respect to adjacent rows of the first end portions 50.

The male connector housing 62 further comprises a plurality of columns of four platforms 72 for supporting the second end portions 52 of the male connector terminals 48 when the second end portions 52 are pressed towards the male connector housing 62. The platforms 72 have non-sharp edges or rounded corners 74 for contacting a bend in the male connector terminals 48. In FIG. 6, the four second end portions 52 of the terminals 48 that contact each of the four platforms 72 in each of the columns of platforms 72 extend in the same direction. However, the second end portions 52 on the platforms 72 in adjacent columns of platforms 72 extend in opposite directions. The second end portions 52 of the male terminals 48 can also be described as being physically arranged in eight rows. Each of the rows of the second end portions 52 is offset with respect to adjacent rows of the second end portions 52.

When the male terminals 48 are through mount connectable terminals 60, each of the columns of the four platforms 72 illustrated in FIG. 6 is for supporting the second end portions 52 of terminals 60 with first end portions 50 that connect to a corresponding column of four holes 16 illustrated in FIG. 1. More specifically, each one of the four platforms 72 in each of the columns of platforms 72 illustrated in FIG. 6 is for contacting and supporting the second end portion 52 of one of the terminals 60 with first end portions 50 that connect to a corresponding column of four holes 16 illustrated in FIG. 1. Further, when the male terminals 48 are through mount connectable terminals 60, the terminal first end portions 50 are substantially perpendicular to the terminal second end portions 52.

When the male terminals 48 are surface connectable terminals 58, each of the columns of the four platforms 72 illustrated in FIG. 6 is for supporting the second end portions 52 of terminals 58 with first end portions 50 that connect to two adjacent corresponding columns of pads 20 illustrated in FIG. 2. More specifically, each one of the four platforms 72 in each of the columns of platforms 72 illustrated in FIG. 6 is for contacting and supporting the second end portion 52 of one of the terminals 58 with first end portions 50 that connect to two adjacent corresponding columns of pads 20 illustrated in FIG. 1. For instance, in FIG. 6, the top and bottom second end portions 52 on the platforms 72 in the far most right column of platforms 72 can be and are illustrated as connectable to the right far most column $c_{50}$ of two pads 20 illustrated in FIG. 2. Then the middle two second end portions 52 on the platforms 72 in the far most right column of platforms 72 can be and are illustrated as connectable to the second column $c_{49}$ of two pads 20 from the right illustrated in FIG. 2. Further, when the male terminals 48 are surface connectable terminals 58, the terminal first end portions 50 are substantially parallel to the terminal second end portions 52.

The male connector housing 62 further defines a serpentine groove 76 extending between and around the columns of the platforms 72.

The male connector housing 62 may further comprise at least two alignment passages 78, one on each end of the platforms 72.

Figures 9, 10, 11:
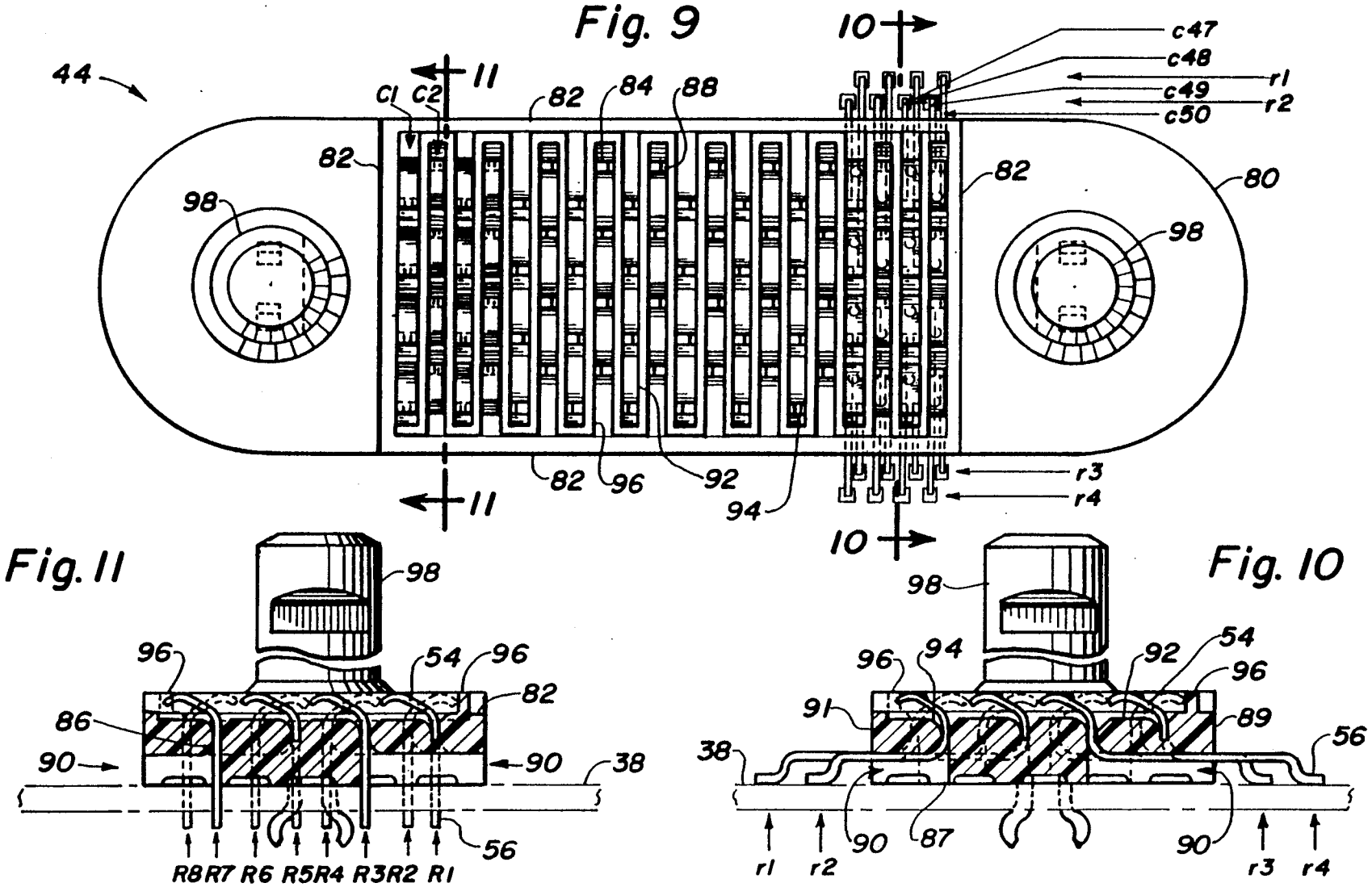
FIG. 9 is a top side view of a female connector taken generally on the line 9—9 in FIG. 5 in the direction of the arrows.
FIG. 10 is a sectional view of the female connector, taken generally on the line 10—10 in FIG. 9 in the direction of the arrows, showing terminals for surface mounting on a circuit board.
FIG. 11 is a sectional view of the female connector, taken generally on the line 11—11 in FIG. 9 in the direction of the arrows, showing terminals for through mounting with a circuit board.

FIG. 9 is a top side view of the female connector 44 taken generally on the line 9—9 in FIG. 5 in the direction of the arrows. FIG. 10 is a sectional view of the female connector 44, taken generally on the line 10—10 in FIG. 9 in the direction of the arrows, showing terminals 58 for surface mounting on the second circuit board 38. FIG. 11 is a sectional view of the female connector 44, taken generally on the line 11—11 in FIG. 9 in the direction of the arrows, showing terminals 60 for through mounting with the second circuit board 38.

Actually, the female connector 44 only has either terminals 58 for surface mounting or terminals 60 for through mounting, not both. In a first embodiment, the female connector 44 is for connecting to the pattern 18 illustrated in FIG. 2. In this first embodiment, all of the terminals 48 of the female connector 44 are surface mounting terminals 58. In a second embodiment, the female connector 44 is for connecting to the pattern 10 illustrated in FIG. 1. In this second embodiment, all of the terminals 48 of the female connector 44 are through mounting terminals 60. However, in order to reduce the number of Figures needed to illustrate both embodiments, a right set $c_{47}$–$c_{50}$ of columns of terminals 48 in FIGS. 4, 5 and 9 are depicted as terminals 58 for surface mounting and a left set $C_1$–$C_2$ of columns of terminals 48 in FIGS. 4, 5 and 9 are depicted as terminals 60 for through mounting. In order to better understand the structure of the assembly 30, the terminals 48 between the left set and the right set are not depicted.

The female connector 44 comprises a terminal 48 for connecting to each conductive region in the pattern 10 or 18. The female terminals 48 can be configured the same as or similar to the male terminals 48. Specifically, each female connector terminal 48 comprises a first end portion or segment 56, a second end portion or segment 54 and a middle portion or segment 86. The first end portions 56 of the female terminals 48 are for electrically and mechanically connecting to the second pattern 40 of the conductive regions 36 of the second circuit board 38. The second end portions 54 of the female connector terminals 48 are for electrically contacting second end portions 52 of the male connector terminals 48.

The female connector 44 further comprises a housing 80 having an indentation 82 surrounding the second end portions 54 of the female connector terminals 48. The housing 80 comprises means for housing the female terminals 48 such that the female terminals are electrically insulated from each other.

The female connector 44 further defines a passage 84 for holding a middle portion or segment 86 of each of the female connector terminals 48. The middle portions 86 are physically arranged in the eight rows $R_1$–$R_8$. Each of the rows $R_1$–$R_8$ of middle portions 86 is offset with respect to adjacent rows. Each passage 84 includes a ledge 88 for contacting a shoulder 69 on the terminal 48 positioned in the passage 84. In FIG. 9, the ledges 88 are on the right side of the passages 84 corresponding to the rows $R_1$, $R_2$, $R_5$ and $R_6$ of the terminals 48. Whereas, the ledges 88 are on the left Side of the passages 84 corresponding to the rows $R_3$, $R_4$, $R_7$ and $R_8$ of the terminals 48.

A plurality of columns of tunnels or grooves 90 exist in a side 87 of the female connector 44 which contacts the circuit board 38. Each of the grooves 90 extends from one of the passages 84 and is shaped to permit the first end portion 56 of the terminal 48 held by the passage 84 to be positioned in the first configuration 58 in the groove 90 when surface mountable to the second circuit board 38 and in the second configuration 60 in the groove 90 when through hole mountable to the second circuit board 38. In other words, each one of the grooves 90 extends from an end of one of the passages 84 vertically towards the bottom of the page in FIGS. 10 and 11 to the surface 87 of the female connector 44 that contacts the second circuit board 38. Each one of the grooves 90 further extends from an end of one of the passages 84 horizontally in FIGS. 10 and 11 to either a right side 89 or a left side 91 of the female connector 44. When the terminals 48 are through hole mountable terminals 60, the first end portions 56 of the terminals 60 are physically arranged in the eight rows $R_1$–$R_8$. Each of the rows $R_1$–$R_8$ of the first end portions 56 is offset with respect to adjacent rows of the first end portions 56. When the terminals 48 are surface mountable terminals 58, the first end portions 56 of the terminals 58 are physically arranged in four rows $r_1$–$r_4$. Each of the rows $r_1$–$r_4$ of the first end portions 56 is offset with respect to adjacent rows of the first end portions 56.

The female connector housing 80 further comprises a plurality of columns of four platforms 92 for supporting the second end portions 54 of the female connector terminals 48 when the second end portions 54 are pressed towards the female connector housing 80. The platforms 92 have non-sharp edges or rounded corners 94 for contacting a bend in the female connector terminals 48. Referring to FIGS. 10 and 11, the four second end portions 54 of the terminals 48 that are positioned above each of the four platforms 92 in each of the columns of platforms 92 extend in the same direction. However, the second end portions 54 that are positioned above the platforms 92 in adjacent columns of platforms 92 extend in opposite directions. The second end portions 54 of the female terminals 48 can also be described as being physically arranged in eight rows. Each of the rows of the second end portions 54 is offset with respect to adjacent rows of the second end portions 54.

When the female terminals 48 are through mount connectable terminals 60, each of the columns of the four platforms 92 illustrated in FIG. 9 is for supporting the second end portions 54 of terminals 60 with first end portions 56 that connect to a corresponding column of four holes 16 illustrated in FIG. 1. More specifically, each one of the four platforms 92 in each of the columns of platforms 92 illustrated in FIG. 9 is for contacting and supporting the second end portion 54 of one of the terminals 60 with first end portions 56 that connect to a corresponding column of four holes 16 illustrated in FIG. 1. Further, when the female terminals 48 are through mount connectable terminals 60, the terminal first end portions 56 are substantially perpendicular to the terminal second end portions 54.

When the female terminals 48 are surface connectable terminals 58, each of the columns of the four platforms 92 illustrated in FIG. 9 is for supporting the second end portions 54 of terminals 58 with first end portions 56 that connect to two adjacent corresponding columns of pads 20 illustrated in FIG. 2. More specifically, each one of the four platforms 92 in each of the columns of platforms 92 illustrated in FIG. 9 is for contacting and supporting the second end portion 54 of one of the terminals 58 with first end portions 56 that connect to two adjacent corresponding columns of pads 20 illustrated in FIG. 1. For instance, in FIG. 9, the top and bottom second end portions 54 on the platforms 92 in the far most right column of platforms 92 can be and are illustrated as connectable to the right far most column $c_{50}$ of two pads 20 illustrated in FIG. 2. Then the middle two second end portions 54 on the platforms 92 in the far most right column of platforms 92 can be and are illustrated as connectable to the second column $c_{49}$ of two pads 20 from the right illustrated in FIG. 2. Further, when the female terminals 48 are surface connectable terminals 58, the terminal first end portions 56 are substantially parallel to the terminal second end portions 54.

The female connector housing 80 further defines a serpentine wall 96 extending between and around the columns of the platforms 92. The serpentine wall 96 mates with and inserts into the serpentine groove 76 in the male connector 42.

The female connector housing 80 may further comprise at least two alignment posts 98, one on each end of the rows and columns of the terminals 48. Each of the alignment posts 98 extends perpendicularly to the platforms 92. Referring to FIG. 5 the alignment posts 98 are for insertion through the alignment passages 78 in the male connector 42, the alignment holes 17 in the first circuit board 32 and then the alignment passages 100 in the latching assembly 46. The alignment posts 98 have a slot 102 for receiving a latch 110 or 112 of the latching assembly 46 which secures the female connector 44, the male connector 42, the first board 32 and the latching assembly 46 together.

The female connector 44 further comprises a pair of board retention members 106 connected to the female connector side 87 and positioned under each of the alignment posts 98. The board retention members 106 are for securing the female connector 44 to the second board 38. Specifically, each one of the retention members 106 in each pair is adapted to flex or bend towards the other retention member 106 in the pair when the pair is inserted into one of the alignment holes or slots 26.

For the purposes of this disclosure, locating the serpentine wall 96 on the male connector housing 62 (rather than on the female connector housing 80) and locating the serpentine groove 76 on the female connector housing 80 (rather than on the male connector housing 62) would be equivalent to the structural arrangement described above.

Further for the purposes of this disclosure, locating the female terminals 48 in the male connector housing 62 (rather than in the female connector housing 80) and locating the male terminals 48 in the female connector housing 80 (rather than in the male connector housing 62) would be equivalent to the structural arrangement described above.

Furthermore for the purposes of this disclosure, locating the exterior walls 64 on the female connector housing 80 (rather than on the male connector housing 62) and locating the indentation 82 on the male connector housing 62 (rather than in the female connector housing 80) would be equivalent to the structural arrangement described above.

Moreover, it would be an equivalent to the above described structure to connect the retention members 106 to the male connector side 65 (rather than to the female connector side 87) for insertion into and securing to alignment holes or slots 26 in the first board 32. In this case, the alignment posts 98 would be on the male connector 42, rather than on the female connector 44. Further, the alignment passages 78 would be in the female connector 44, rather than through the male connector 42. In this case, the posts 98 on the male connector 42 would be for inserting through the passages 78 in the female connector 44, the holes 17 in the second board 38 and then the passages 100 in the latching assembly 46.

The latching assembly 46 comprises a latching block 108, a first latch 110, a second latch 112, a spring block 114 and a compression spring 116. The latching block 108 defines the two alignment passages 100 and a slot 118 connecting the alignment passages 100. The latching block 108 further defines an indentation or hollow space 109 for receiving the first end portions 50 of the male through mounting terminals 60 which extend through the board 32. The first latch 110 is slideably positioned in the slot 118. The second latch 112 is also slideably positioned in the slot 118. The spring block 114 has a passage 120 positioned in the slot 118 between the first latch 110 and the second latch 112. The compression spring 116 extends between the first latch 110 through the spring block passage 120 to the second latch 112 biasing distal ends of the first latch 110 and the second latch 112 into the two alignment passages 100. The distal ends of the first latch 110 and the second latch 112 are configured to fit into the slots 102 in the posts 98.

In operation, when the posts 98 are inserted into the passages 100, a leading end of the posts 98 pushes the distal ends of the latches 110 and 112 out of the passages 100 until the slots 102 are positioned to allow the distal ends of the latches 110 and 112 to be forced into the slots 102 by the compression spring 116. The latch assembly 46 can be detached from the posts 98 by squeezing finger grips 122 on the latches 110 and 112 towards one another and lifting the latch assembly 46 off the posts 98.

Figure 12:
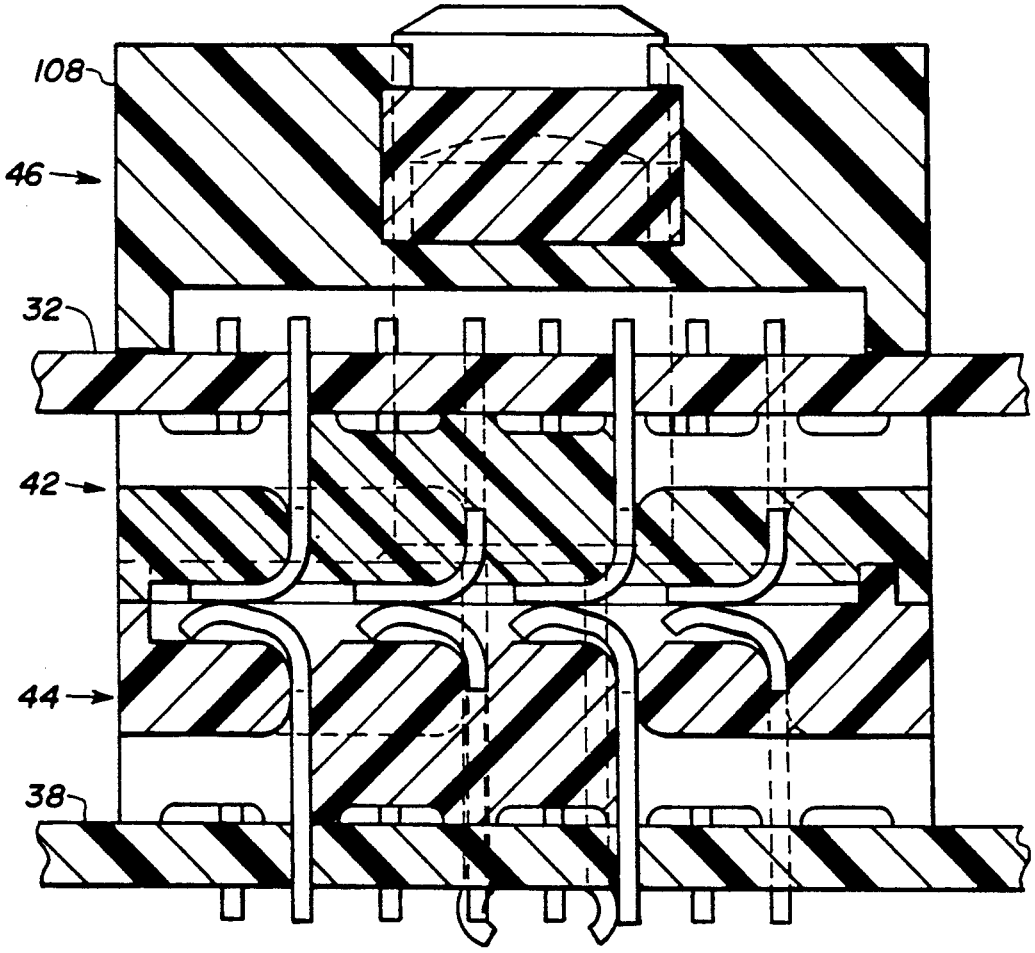
FIG. 12 is a sectional view of the high density connector assembly, taken generally on the line 12—12 in FIG. 4 in the direction of the arrows, showing terminals for through mounting with a circuit board.

FIG. 12 is a sectional view of the high density connector 30, taken generally on the line 12—12 in FIG. 4 in the direction of the arrows. This sectional view shows through mounting terminals 60 in both the female connector 44 and the male connector 42. FIG. 12 shows that when the male connector 42 and the female connector 44 are mated together, the second end portions 52 and 54, respectively, that contact one another extend in the same direction. Further, due to the angled position of the second end portions 54 above the platforms 92 in the female connector 44, the second end portions 54 slide or wipe against the second end portions 52 in the male connector 42 when the female connector 44 and the male connector 42 are forced together as shown in FIG. 12. As the second end portions 54 slide or wipe against the second end portions 52, the second end portions 54 also flex or bend towards the platforms 92.

Figure 13:
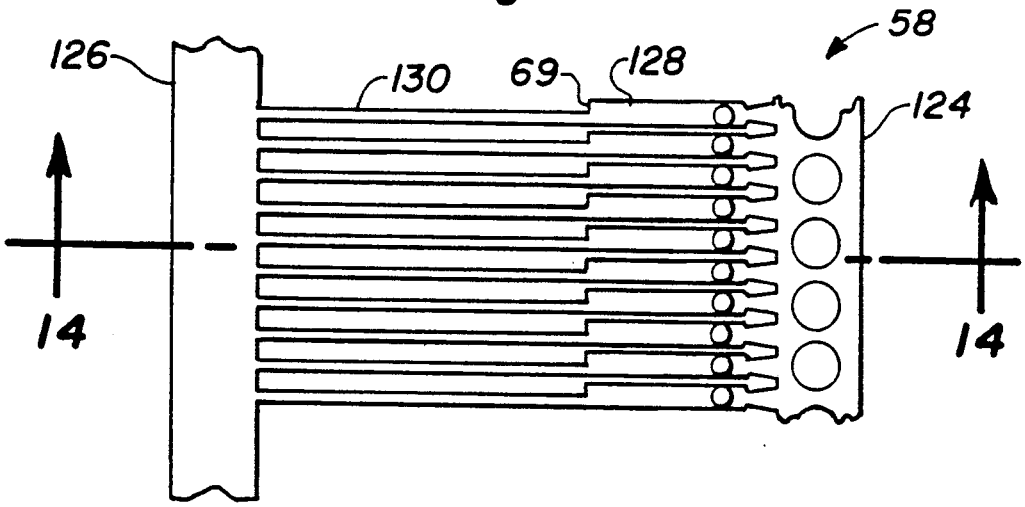
FIG. 13 illustrates a first terminal in accordance with the present invention in a substantially flat stage attached to a carrying strip and a support strip.
Figure 14:
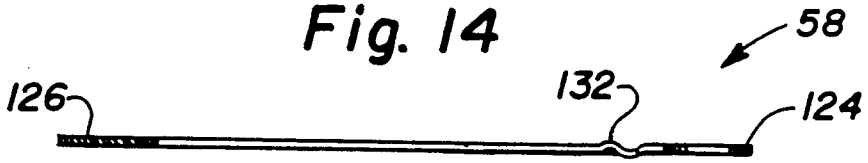
FIG. 14 is a sectional view of the first terminal, taken generally on the line 14—14 in FIG. 13 in the direction of the arrows.

FIG. 13 illustrates an embodiment of the surface mounting terminal 58 in accordance with the present invention in a substantially flat stage attached to a carrying strip 124 and a support strip 126. FIG. 14 is a sectional view showing the thickness of the surface mounting terminal 58, taken generally on the line 14—14 in FIG. 13 in the direction of the arrows. The carrying strip 124 and the support strip 126 are trimmed away leaving the surface mounting terminals 58 having a wider portion 128 and a narrower portion 130. The shoulder 69 is the transition between the wider portion 128 and the narrower portion 130. The shoulder 69 is in the middle portion 68, 86 of the surface mounting terminals 58. The wider portion 128 includes the second end portions 52 and 54 of the surface mounting terminals 58. The narrower portions 130 includes the first end portions 50 and 56 of the surface mounting terminals 58. A bump 132 can be embossed or formed in one or more sides of the wider portion of the female terminals 48 to provide better contact between the second end portions 52 of the male terminals 48 and the second end portions 54 of the female terminals 48. Preferably, the bumps 132 on the terminals 48 in female connector 44 extend towards the terminals 48 in the male connector 42.

Figure 15:
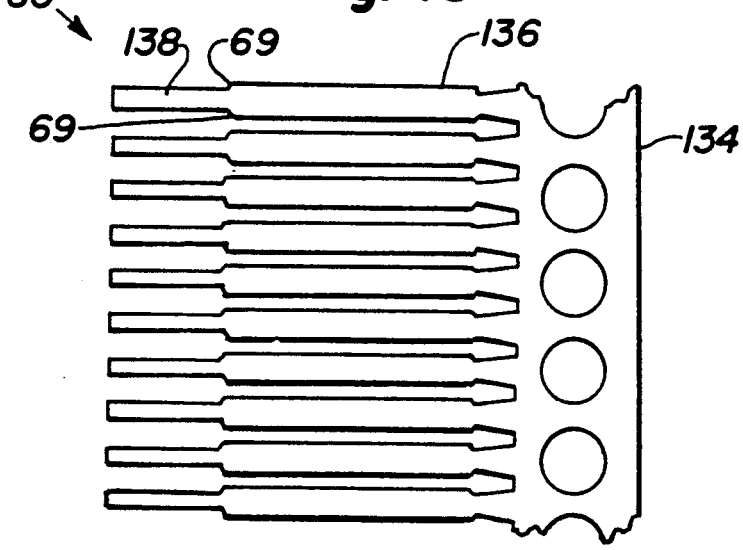
FIG. 15 illustrates a second terminal in accordance with the present invention in a substantially flat stage attached to a carrying strip and a support strip.

FIG. 15 illustrates an embodiment of the through mounting terminal 60 in accordance with the present invention in a substantially flat stage attached to a carrying strip 134. The carrying strip 134 is trimmed away leaving the through mounting terminals 60 having a wider portion 136 and a narrower portion 138. The through mounting terminal 60 has two shoulders 69 at the transition between the wider portion 136 and a narrower portion 138. The shoulders 69 are in the middle portions 68, 86 of the through mounting terminals 60. The wider portion 136 includes the second end portions 52, 54 of the through mounting terminals 60. The narrower portions 138 comprise the first end portions 50 and 56 of the through mounting terminals 60. The thickness of the through mounting terminals 60 can be the same as the thickness of the surface mounting terminals 58.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A connector assembly for electrically and mechanically interconnecting a first circuit board having a first pattern of conductive regions with a second circuit board having a second pattern of conductive regions, the first circuit board being substantially parallel to and spaced apart from the second circuit board, the assembly comprising:

a male connector having a male connector terminal corresponding to each first pattern conductive region, each male connector terminal having a first end portion for connecting to one of the first pattern conductive regions and a second end portion, the second end portions of the male connector terminals arranged in columns with the second end portions of the male connector terminals in adjacent columns extending in opposite directions; and a female connector having a female connector terminal corresponding to each second pattern conductive region, each female connector terminal having a first end portion for connecting to one of the second pattern conductive regions and a second end portion for electrically contacting the second end portions of the male connector terminals, the second end portions of the female connector terminals arranged in columns with the second end portions of the female connector terminals in adjacent columns extending in opposite directions.

2. A connector assembly for electrically and mechanically interconnecting a first circuit board having a first pattern of conductive regions with a second circuit board having a second pattern of conductive regions, the first circuit board being substantially parallel to and spaced apart from the second circuit board, the connector assembly comprising:

a male connector having male connector terminals with segments positioned in eight rows, each row having ten of the male connector terminals per inch along the row, each of the male connector terminals having a first end portion and a second end portion, the first end portions of the male connector terminals for electrically and mechanically connecting to the first pattern of conductive regions of the first circuit board, the second end portions of the male connector terminals arranged in columns with the second end portions of the male connector terminals in adjacent columns extending in opposite directions; and a female connector having female connector terminals with segments positioned in eight rows, each row having ten of the female connector terminals per inch along the row, each of the female connector terminals having a first end portion and a second end portion, the first end portions of the female connector terminals for electrically and mechanically connecting to the second pattern of conductive regions of the second circuit board, the second end portions of the female connector terminals arranged in columns with the second end portions of the female connector terminals in adjacent columns extending in opposite directions, the second end portions of the male connector terminals for electrically contacting the second end portions of the female connector terminals.

3. The connector assembly of claim 2, wherein:

the male connector terminal segments are middle portions of the male connector terminals or the first end portions of the male connector terminals; and the female connector terminal segments are middle portions of the female connector terminals or the first end portions of the female connector terminals.

4. The connector assembly of claim 2, wherein the male connector terminals are through mount connectable or surface mount connectable to the first board.

5. The connector assembly of claim 2, wherein the female connector terminals are through mount connectable or surface mount connectable to the second board.

6. The connector assembly of claim 2, wherein the conductive regions of at least one of the first pattern and the second pattern comprises eight rows of conductive plated holes through the board, the holes spaced about 0.1 inches (2.54 mm) from hole center to hole center of adjacent holes along the rows of holes, the holes having a diameter of about 0.020 inches (0.51 mm), the rows spaced about 0.075 inches (1.91 mm) apart from adjacent rows.

7. The connector assembly of claim 2, wherein the conductive regions of at least one of the first pattern and the second pattern comprises 4 rows of conductive pads on the board, the pads spaced about 0.050 inches (1.27 mm) apart along the rows of the pads.

8. The connector assembly of claim 2, wherein the male connector further comprises:

a housing having walls surrounding the second end portions of the male connector terminals, a passage for holding a middle portion of each of the male connector terminals, a plurality of columns of grooves, each of the grooves connected to at least one of the passages and shaped to permit the male connector terminal held by the passage to be positioned in a first configuration in the groove when surface mountable to the first circuit board and in a second configuration in the groove when through hole mountable to the first circuit board.

9. The connector assembly of claim 8, wherein the male connector housing further comprises:

at least two alignment passages.

10. The connector assembly of claim 2, wherein:

the male connector terminal first end portions are substantially perpendicular to the male connector terminal second end portions.

11. The connector assembly of claim 2, wherein:

the male connector terminal first end portions are substantially parallel to the male connector terminal second end portions.

12. The connector assembly of claim 2, wherein the female connector further comprises:

a housing having an indentation surrounding the second end portions of the female connector terminals, a passage for holding a middle portion of each of the female connector terminals, a plurality of columns of grooves, each of the grooves connected to at least one of the passages and shaped to permit the female connector terminal held by the passage to be positioned in a first configuration in the groove when surface mountable to the second circuit board and in a second configuration in the groove when through hole mountable to the second circuit board.

13. The connector assembly of claim 12, wherein the female connector housing further comprises:

at least two alignment posts, each of the posts having a slot.

14. The connector assembly of claim 2, wherein the female connector further comprises:

at least two flexible arms for mounting the female connector to the second board.

15. A connector assembly for electrically and mechanically interconnecting a first circuit board having a first pattern of conductive regions with a second circuit board having a second pattern of conductive regions, the first circuit board being substantially parallel to and spaced apart from the second circuit board, the connector assembly comprising:

a male connector having male connector terminals with segments positioned in a plurality of rows, each row having a plurality of the male connector terminals per inch along the row, each of the male connector terminals having a first end portion and a second end portion, the first end portions of the male connector terminals for electrically and mechanically connecting to the first pattern of conductive regions of the first circuit board, the male connector further comprising:

a housing having walls surrounding the second end portions of the male connector terminals, a passage for holding a middle portion of each of the male connector terminals, a plurality of columns of grooves, each of the grooves connected to at least one of the passages and shaped to permit the male connector terminals held by the passage to be positioned in a first configuration in the groove when surface mountable to the first circuit board and in a second configuration in the groove when through hole mountable to the first circuit board;

a plurality of columns of a plurality of platforms for contacting the second end portions of the male connector terminals, the platforms having non-sharp edges for contacting a bend in the male connector terminals; and a serpentine groove extending between and around the columns of the platforms; and a female connector having female connector terminals with segments positioned in a plurality of rows, each row having a plurality of the female connector terminals per inch along the row, each of the female connector terminals having a first end portion and a second end portion, the first end portions of the female connector terminals for electrically and mechanically connecting to the second pattern of conductive regions of the second circuit board, the second end portions of the male connector terminals for electrically contacting the second end portions of the female connector terminals.

16. The connector assembly of claim 15, wherein:

each of the columns of the plurality of platforms is for contacting the male connector terminal second end portions corresponding to one column of four conductive regions in the first pattern, one of the male connector terminal second end portions on each one of the platforms, with each of the male connector terminal second end portions extending in the same direction.

17. The connector assembly of claim 15, wherein:

each of the columns of the plurality of platforms is for contacting the male connector terminal second end portions corresponding to two columns of conductive regions in the first pattern, one of the male connector terminal second end portions on each one of the platforms, with each of the corresponding male connector terminal second end portions extending in the same direction.

18. A connector assembly for electrically and mechanically interconnecting a first circuit board having a first pattern of conductive regions with a second circuit board having a second pattern of conductive regions, the first circuit board being substantially parallel to and spaced apart from the second circuit board, the connector assembly comprising:

a male connector having male connector terminals with segments positioned in a plurality of rows, each row having a plurality of the male connector terminals per inch along the row, each of the male connector terminals having a first end portion and a second end portion, the first end portions of the male connector terminals for electrically and mechanically connecting to the first pattern of conductive regions of the first circuit board, the male connector terminal second end portions corresponding to adjacent columns of the platforms extend in opposite directions, the male connector further comprising:

a housing having walls surrounding the second end portions of the male connector terminals, a passage for holding a middle portion of each of the male connector terminals, a plurality of columns of grooves, each of the grooves connected to at least one of the passages and shaped to permit the male connector terminal held by the passage to be positioned in a first configuration in the groove when surface mountable to the first circuit board and in a second configuration in the groove when through hole mountable to the first circuit board;

a plurality of columns of a plurality of platforms for contacting the second end portions of the male connector terminals, the platforms having non-sharp edges for contacting a bend in the male connector terminals; and a serpentine groove extending between and around the columns of the platforms; and a female connector having female connector terminals with segments positioned in a plurality of rows, each row having a plurality of the female connector terminals per inch along the row, each of the female connector terminals having a first end portion and a second end portion, the first end portions of the female connector terminals for electrically and mechanically connecting to the second pattern of conductive regions of the second circuit board, the second end portions of the male connector terminals for electrically contacting the second end portions of the female connector terminals.

19. A connector assembly for electrically and mechanically interconnecting a first circuit board having a first pattern of conductive regions with a second circuit board having a second pattern of conductive regions, the first circuit board being substantially parallel to and spaced apart from the second circuit board, the connector assembly comprising:

a male connector having male connector terminals with segments positioned in a plurality of rows, each row having a plurality of the male connector terminals per inch along the row, each of the male connector terminals having a first end portion and a second end portion, the first end portions of the male connector terminals for electrically and mechanically connecting to the first pattern of conductive regions of the first circuit board; and a female connector having female connector terminals with segments positioned in a plurality of rows, each row having a plurality of the female connector terminals per inch along the row, each of the female connector terminals having a first end portion and a second end portion, the first end portions of the female connector terminals for electrically and mechanically connecting to the second pattern of conductive regions of the second circuit board, the second end portions of the male connector terminals for electrically contacting the second end portions of the female connector terminals, the female connector further comprising:

a housing having an indentation surrounding the second end portions of the female connector terminals, a passage for holding a middle portion of each of the female connector terminals, a plurality of columns of grooves, each of the grooves connected to at least one of the passages and shaped to permit the female connector terminals held by the passage to be positioned in a first configuration in the groove when surface mountable to the second circuit board and in a second configuration in the groove when through hole mountable to the second circuit board;

a plurality of columns of a plurality of platforms, each platform positioned near one of the second end portions of the female connector terminals, the platforms having non-sharp edges for contacting a bend in the female connector terminals; and a serpentine wall extending between and around the columns of the platforms.

20. The connector assembly of claim 19, wherein:

each set of the plurality of the female connector terminal second end portions corresponding to each column of the platforms is for connecting to one column of conductive regions in the second pattern, with each of the female connector terminal second end portions corresponding to each column of the platforms extending in the same direction.

21. The connector assembly of claim 19, wherein:

each set of female connector terminal second end portions corresponding to each column of the platforms is for connecting to two columns of conductive regions in the second pattern, with each of the female connector terminal second end portions corresponding to each column of the platform extending in the same direction.

22. The connector assembly of claim 19, wherein:

the female connector terminal second end portions corresponding to adjacent columns of the platforms extend in opposite directions.

23. A connector assembly for electrically and mechanically interconnecting a first circuit board having a first pattern of conductive regions with 80 or about 80 lead lines per inch with a second circuit board having a second pattern of conductive regions with 80 or about 80 lead lines per inch, the first circuit board being substantially parallel to and spaced apart from the second circuit board, the connector assembly comprising:

a male connector having male connector terminals with segments positioned in eight rows, each row having ten of the male connector terminals per inch along the row, each of the male connector terminals having a first end portion and a second end portion, the first end portions of the male connector terminals for electrically and mechanically connecting to the first pattern of conductive regions of the first circuit board;

a female connector having female connector terminals with segments positioned in eight rows, each row having ten of the female connector terminals per inch along the row, each of the female connector terminals having a first end portion and a second end portion, the first end portions of the female connector terminals for electrically and mechanically connecting to the second pattern of conductive regions of the second circuit board, the second end portions of the male connector terminals for electrically contacting the second end portions of the female connector terminals; and a latching assembly comprising a latching block having two alignment passages and a slot connecting the alignment passages; a first latch slideably positioned in the slot; a second latch slideably positioned in the slot; a spring block having a passage positioned in the slot between the first latch and the second latch; and a compression spring extending between the first latch through the spring block passage to the second latch biasing distal ends of the first latch and the second latch into the two alignment passages.

24. A connector for electrically and mechanically connecting to a pattern of eight rows of plated holes through a circuit board providing a linear density of 80 or about 80 lead lines per inch, the connector comprising:

a terminal corresponding to each hole, each terminal having a first end portion for connecting to one of the holes and a second end portion for connecting to a conductor, the second end portions arranged in columns with the second end portions in adjacent columns extending in opposite directions; and means for housing the terminals such that the terminals are electrically insulated from each other.

25. A connector for electrically and mechanically connecting to a pattern of four rows of conductive pads on a circuit board providing a linear density of 80 or about 80 lead lines per inch, the connector comprising:

a terminal corresponding to each pad, each terminal having a first end portion for connecting to one of the pads and a second end portion for connecting to a conductor, the second end portions arranged in columns with the second end portions in adjacent columns extending in opposite directions; and means for housing the terminals such that the terminals are electrically insulated from each other.

26. A male connector for electrically and mechanically connecting to a circuit board having a pattern of conductive regions, the male connector comprising:

terminals with segments positioned in eight rows, each row having a plurality of the terminals per inch along the row, each of the terminals having a first end portion and a second end portion, the first end portions of the terminals for electrically and mechanically connecting to the pattern of conductive regions of the circuit board, the second end portions arranged in columns with the second end portions in adjacent columns extending in opposite directions; and a housing having walls surrounding the second end portions of the terminals, a passage for holding a middle portion of each of the terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board.

27. The connector of claim 26, wherein the male connector housing further comprises:

at least two alignment passages.

28. The connector of claim 26, wherein:

the terminal first end portions are substantially perpendicular to the terminal second end portions.

29. The connector of claim 26, wherein:

the terminal first end portions are substantially parallel to the terminal second end portions.

30. A male connector for electrically and mechanically connecting to a circuit board having a pattern of conductive regions with a plurality of lead lines per inch, the male connector comprising:

terminals with segments positioned in a plurality of rows, each row having a plurality of the terminals per inch along the row, each of the terminals having a first end portion and a second end portion, the first end portions of the terminals for electrically and mechanically connecting to the pattern of conductive regions of the circuit board;

a housing having walls surrounding the second end portions of the terminals, a passage for holding a middle portion of each of the terminals, a plurality of columns of grooves, each of the grooves connected to at least one of the passages and shaped to permit the terminals held by the passage to be positioned in a first configuration in the groove when surface mountable to the circuit board and in a second configuration in the groove when through hole mountable to the circuit board, wherein the male connector housing further comprises:

a plurality of columns of a plurality of platforms for contacting the second end portions of the terminals, the platforms having non-sharp edges for contacting a bend in the terminals; and a serpentine groove extending between and around the columns of the platforms.

31. The connector of claim 30, wherein:

each of the columns of the platforms is for contacting the terminal second end portions corresponding to one column of conductive regions in the pattern, one of the terminal second end portions on each one of the platforms, with each of the terminal end portions in each column extending in the same direction.

32. The connector of claim 30, wherein:

each of the columns of the platforms is for contacting the terminal second end portions corresponding to two columns of conductive regions in the pattern, one of the terminal second end portions on each one of the platforms, with each of the terminal second end portions in each column extending in the same direction.

33. A male connector for electrically and mechanically connecting to a circuit board having a pattern of conductive regions with a plurality of lead lines per inch, the male connector comprising:

terminals with segments positioned in a plurality of rows, each row having a plurality of the terminals per inch along the row, each of the terminals having a first end portion and a second end portion, the first end portions of the terminals for electrically and mechanically connecting to the pattern of conductive regions of the circuit board;

a housing having walls surrounding the second end portions of the terminals, a passage for holding a middle portion of each of the terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board, wherein the male connector housing further comprises:

a plurality of columns of a plurality of platforms for contacting the second end portions of the terminals, the platforms having non-sharp edges for contacting a bend in the terminals; and a serpentine groove extending between and around the columns of the platforms; and wherein:

the terminal second end portions corresponding to adjacent columns of the platforms extend in opposite directions.

34. A female connector for electrically and mechanically connecting to a circuit board having a pattern of conductive regions, the female connector comprising:

terminals with segments positioned in eight rows, each row having a plurality of the terminals per inch along the row, each of the terminals having a first end portion and a second end portion, the first end portions of the terminals for electrically and mechanically connecting to the pattern of conductive regions of the circuit board, the second end portions arranged in columns with the second end portions in adjacent columns extending in opposite directions; and a housing having an indentation surrounding the second end portions of the terminals, a passage for holding a middle portion of each of the terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board.

35. The female connector of claim 34, wherein the female connector housing further comprises:

at least two alignment posts, each of the posts having a slot.

36. The female connector of claim 34, wherein the female connector further comprises:

at least two flexible arms for mounting the female connector to the circuit board.

37. A female connector for electrically and mechanically connecting to a circuit board having a pattern of conductive regions with a plurality of lead lines per inch, the female connector comprising:

terminals with segments positioned in a plurality of rows, each row having a plurality of the terminals per inch along the row, each of the terminals having a first end portion and a second end portion, the first end portions of the terminals for electrically and mechanically connecting to the pattern of conductive regions of the circuit board; and a housing having an indentation surrounding the second end portions of the terminals, a passage for holding a middle portion of each of the terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board, wherein the female connector housing further comprises:

a plurality of columns of a plurality of platforms, each platform positioned near one of the second end portions of the terminals, the platforms having non-sharp edges for contacting a bend in the terminals; and a serpentine wall extending between and around the columns of the platforms.

38. The female connector of claim 37, wherein:

each set of the terminal second end portions corresponding to each column of the platforms is for connecting to one column of conductive regions in the pattern, with each of the terminal second end portions corresponding to each column of the platforms extending in the same direction.

39. The female connector of claim 37, wherein:

each set of the terminal second end portions corresponding to each column of the platforms is for connecting to two columns of conductive regions in the pattern, with each of the terminal second end portions corresponding to each column of the platforms extending in the same direction.

40. A female connector for electrically and mechanically connecting to a circuit board having a pattern of conductive regions with a plurality of lead lines per inch, the female connector comprising:

terminals with segments positioned in a plurality of rows, each row having a plurality of the terminals per inch along the row, each of the terminals having a first end portion and a second end portion, the first end portions of the terminals for electrically and mechanically connecting to the pattern of conductive regions of the circuit board; and a housing having an indentation surrounding the second end portions of the terminals, a passage for holding a middle portion of each of the terminals, a plurality of columns of grooves, each of the grooves connected to at least one of the passages and shaped to permit the terminal held by the passage to be positioned in a first configuration in the groove when surface mountable to the circuit board and in a second configuration in the groove when through hole mountable to the circuit board, wherein the female connector housing further comprises:

a plurality of columns of a plurality of platforms, each platform positioned near one of the second end portions of the terminals, the platforms having non-sharp edges for contacting a bend in the terminals; and a serpentine wall extending between and around the columns of the platforms; and wherein:

the terminal second end portions corresponding to adjacent columns of the platforms extend in opposite directions.

* * * * *